US010847131B2

(12) United States Patent
Baker

(10) Patent No.: US 10,847,131 B2
(45) Date of Patent: Nov. 24, 2020

(54) MODIFICATIONS TO A LIPSTICK-STYLE PICKUP HOUSING AND CORE TO ALLOW SIGNAL PHASE REVERSALS IN HUMBUCKING CIRCUITS

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/752,670

(22) Filed: Jan. 26, 2020

(65) Prior Publication Data

US 2020/0184938 A1 Jun. 11, 2020

Related U.S. Application Data

(63) Continuation-in-part of application No. 16/139,027, filed on Sep. 22, 2018, now Pat. No. 10,380,986, and a continuation-in-part of application No. 15/917,389, filed on Jul. 14, 2018, and a continuation-in-part of application No. 15/616,396, filed on Jun. 7, 2017, now Pat. No. 10,217,450, and a continuation-in-part of application No. 14/338,373, filed on Jul. 23, 2014, now Pat. No. 9,401,134.

(51) Int. Cl.
*G10H 3/18* (2006.01)
*G10H 3/14* (2006.01)

(52) U.S. Cl.
CPC ..... *G10H 3/181* (2013.01); *G10H 3/143* (2013.01); *G10H 2220/515* (2013.01)

(58) Field of Classification Search
CPC ..... G10H 3/181; G10H 2220/515; G10H 2220/505
See application file for complete search history.

(56) References Cited

U.S. PATENT DOCUMENTS

| | | | | |
|---|---|---|---|---|
| 4,220,069 | A | 9/1980 | Fender | |
| 4,379,421 | A | 4/1983 | Nunan | |
| 5,391,831 | A | 2/1995 | Lace | |
| 5,408,043 | A | 4/1995 | Lace | |
| 5,422,432 | A | 6/1995 | Lace | |
| 5,525,750 | A | 6/1996 | Beller | |
| 9,401,134 | B2 | 7/2016 | Baker | |
| 10,115,383 | B2 * | 10/2018 | Shaw | G10H 3/143 |
| 10,217,450 | B2 | 2/2019 | Baker | |
| 10,380,986 | B2 | 8/2019 | Baker | |
| 2018/0061389 | A1 * | 3/2018 | Berg | G10D 1/085 |

(Continued)

OTHER PUBLICATIONS

Baker, DL, Making guitars with multiple tonal characters, Mar. 2018, DOI: 10.13140/RG.2.2.29053.26081, https://www.researchgate.net/publication/323686205_Making_Guitars_with_Multiple_Tonal_Characters.

(Continued)

*Primary Examiner* — Daniel J Colilla

(57) ABSTRACT

This invention discloses a pickup based upon the core of a common lipstick pickup for an electric stringed musical instrument with a core and housing, the core comprised of a magnet, coil form, and a wire coil connected to electrical contacts on the coil form, and a separate housing providing mounting to the body of the instrument and mating electrical contacts for that core, such that the core can be removed from the housing, flipped so as to reverse the magnetic field towards the strings, and reinserted into the housing, such that any humbucking circuit constructed with other matching pickups will remain humbucking.

15 Claims, 7 Drawing Sheets

(56) References Cited

U.S. PATENT DOCUMENTS

| | | | | |
|---|---|---|---|---|
| 2018/0204558 | A1* | 7/2018 | Canivell Grifols .... | G10H 3/181 |
| 2019/0057679 | A1 | 2/2019 | Baker | |

OTHER PUBLICATIONS

Baker, DL, https://www.researchgate.net/publication/333203140_Title_of_Invention_Single-Coil_Pickup_with_Reversible_Magnet_Pole_Sensor, Jan. 2019, published version of U.S. Appl. No. 15/917,389 on ReserachGate.net.

* cited by examiner

MODIFICATIONS TO A LIPSTICK-STYLE PICKUP HOUSING AND CORE TO ALLOW SIGNAL PHASE REVERSALS IN HUMBUCKING CIRCUITS

This application claims the benefit of precedence of the following U.S. Patents and Patent Applications: by continuation in part of U.S. Pat. No. 9,401,134 (Baker, 2016 Jul. 26), U.S. Pat. No. 10,217,450 (Baker, 2019 Feb. 26) and U.S. Pat. No. 10,380,986 (Baker, 2019 Aug. 13); by continuation in part of U.S. Non-Provisional patent application Ser. No. 15/917,389 (Baker, 2018 Jul. 14), as published in "333203140 Title of Invention Single-Coil_Pickup_with_Reversible_Magnet_Pole_Sensor" on researchgate.net (January 2019); and is meant to be used in conjunction with U.S. Non-Provisional patent application Ser. No. 16/156,509, published as US 2019/0057679 A1 and the patents cited above; by this inventor, Donald L. Baker dba android originals LC, Tulsa Okla. USA

COPYRIGHT AUTHORIZATION

Other than for confidential and/or necessary use inside the Patent and Trademark Office, this authorization is denied until the Nonprovisional Patent Application is published (pending the request for delay of publication below), at which time it may be taken to state:

The entirety of this application, specification, claims, abstract, drawings, tables, formulae etc., is protected by copyright: © 2019 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

Not Applicable

CROSS-REFERENCE TO RELATED APPLICATIONS

This application is related to the patents and applications cited above for benefit, filed by this inventor, Donald L. Baker dba android originals LC, Tulsa Okla. USA.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

Not Applicable

TECHNICAL FIELD

This invention describes electro-magnetic string vibration pickups, primarily used in guitars and basses, also applicable to other musical instruments with ferrous strings, such a pianos, to be used in humbucking circuit arrangements in which each pickup responds equally to external electromagnetic fields, otherwise known a hum.

REFERENCES

U.S. Pat. No. 4,220,069, Fender, 1980 Sep. 2

U.S. Pat. No. 4,379,421, Nunan, 1983 Apr. 12, Electric pickups

U.S. Pat. No. 5,391,831, Lace, 1995 Feb. 21, Electromagnetic musical pickup having u-shaped ferromagnetic core U.S. Pat. No. 5,408,043, Lace, 1995 Apr. 18, Electromagnetic musical pickups with central permanent magnets U.S. Pat. No. 5,422,432, Lace, 1995 Jun. 6, Electromagnetic pickup for a plural-string musical instrument incorporating a coil around a multi-laminate ferromagnetic core U.S. Pat. No. 5,525,750, Beller, 1996 Jun. 11, Humbucking pickup for electric guitar U.S. Pat. No. 9,401,134 B2, Baker, 2016 Jul. 26, Acoustic-electric stringed instrument with improved body, electric pickup placement, pickup switching and electronic circuit, from NPPA Ser. No. 14/338,373 filed 2014 Jul. 23

Baker, D. L., 2018, Making guitars with multiple tonal characters, as published on researchgate.net in "323686205_Making_Guitars_with_Multiple_Tonal_Characters", March 2018, DOI: 10.13140/RG2.2.29053.26081

U.S. NPPA Ser. No. 15/917,389, Baker, 2018 July 14, Single-coil pickup with reversible magnet & pole sensor, US 2019/0057679 A1, Baker, 2019 Feb. 21, Means and methods for obtaining humbucking tones from variable gains, filed as NPPA Ser. No. 16/156,509 2018 Oct. 10

U.S. Pat. No. 10,217,450 B2, Baker, 2019 Feb. 26, Humbucking switching arrangements and methods for stringed instrument pickups, files as NPPA Ser. No. 15/616,396 2017 Jun. 7

U.S. Pat. No. 10,380,986 B2, Baker, 2019 Aug. 13, Means and methods for switching odd and even numbers of matched pickups to produce all humbucking tones, from NPPA Ser. No. 16/139,027 filed 2018 Sep. 22.

Baker, D. L., 2020, Sensor Circuits and Switching for Stringed Instruments, humbucking pairs, triples, quads and beyond, © Springer Nature Switzerland AG 2020, ISBN 978-3-030-23123-1, ~235 pp, available on Amazon.com and Springer.com.

BACKGROUND AND PRIOR ART

FIG. 1 shows a generic lipstick pickup core of the type intended to modification, drawn from a photo. Most of it is covered around the sides by plastic tape (1), which covers and protects the wire coil (not shown). The top shows the upper flange (3) of the plastic coil form (hidden under the tape), with a hole in the core (5) for the ceramic magnet (7), which is not quite level with the top of the flange. The pickup wires (9 & 11) bring the end connections to the inner and outer turns of the coil out through the tape.

FIG. 2 is a copy of FIG. 1 from U.S. Pat. No. 4,379,421, Nunan, 1983, with different identifiers, the only other patent drawing by another inventor that Baker could find showing a pickup that has any capability of flipping pole orientation with any ease. Nunan's identifiers 1 to 13 are shown here as 13 to 25. The full description is in Nunan, just subtract 12 from the identifier here to get Nunan's. Otherwise the pickup wires (19) connect to the coil windings (18), wrapped around the magnet (13) in a coil form (14, 15, 16 & 17). Mounting arms (20, 21, 22 & 23) extend from the magnet to the mounting screws (24 & 25). The direction of the magnetic field goes from one flat to the other (15 & 16), and the pickup and field are reversed by removing the mounting screws, flipping the entire pickup and replacing the screws.

FIG. 3 is one embodiment of the basic pickup coil form, unmodified, made of non-magnetic and non-conductive material, with a top view (27) and a side view (29). It has a plate-like top flange (31), a plate-like bottom flange (33), and a central column (35), with hole (37) in which to place the pickup magnet (not shown). The pickup coil (not shown) is wound in the trough formed around the column by the flanges. This embodiment is more suitable for ceramic magnets, which are more brittle than Alnico magnets.

FIG. 4 is another embodiment of the basic coil form, unmodified, with a top view (39), a side view (41), a top flange (43) and a bottom flange (45). Here, instead of a hollow column connecting the top and bottom flange, the magnet (47) is the column, which is fixed to close-fitting holes (not shown) in the flanges by adhesive. The pickup coil (not shown) is wound in the trough formed around the magnet by the flanges. This embodiment is more suitable for more physically rugged metal-based magnets, such as Alnico.

While a 3-coil strat-type electric guitar is known to be nominally humbucking in the combinations of the bridge and middle coils and the middle and neck, Baker (U.S. Pat. No. 9,401,134, 2016; US NPPA Ser. No. 15/917,389, 2018; US 2109/0057679A1; U.S. Pat. No. 10,217,450 B2, 2019; and U.S. Pat. No. 10,380,986, 2019) appears to be the first to develop the use of 2 or more matched single-coil pickups in humbucking circuits. On a 3-coil strat-type guitar, the bridge pickup is typically hotter than the middle and neck pickups, and thus not quite matched. Instead, humbucking pickups have previously been limited to 2-coil pickups of various configurations, typically sharing a magnet, while all single-coil pickups have previously been considered non-humbucking.

Baker (2018; US NPPA Ser. No. 15/917,389, 2018; 2020) had discovered that all matched single-coil pickups can have coils wound exactly the same way, and be combined into humbucking circuits merely by assuring that the hum signals cancel, regardless of the phase of the string signal due to the orientation of the magnets in the pickups. This means that if the magnets are easily hand-reversible in J number of pickups, then there are $2^{J-1}$ number of overlapping tonal characters, producing 2, 4, 8 and 16 different tonal characters for guitars with 2, 3, 4 and 5 matched pickup coils. The differences reside in which pickups are in or out of phase with each other, depending upon the circuit and the magnetic field directions of the pickups.

When most other patents refer to reversing the polarity of the magnet (Fender, U.S. Pat. No. 4,220,069; Lace U.S. Pat. Nos. 5,391,831, 5,408,043 and 5,422,432; Beller U.S. Pat. No. 5,525,750), they refer to the principles of operation and the time of manufacture, not something easily reversed by hand once made. These pickups are generally made as solid as possible, including such techniques as wax-potting, to assure that nothing moves and causes microphonics. They are not made to be easily or casually disassembled.

The only exception that Baker found to this in prior art is U.S. Pat. No. 4,379,421, Nunan, 1983. The entire single-coil pickup is designed so that it can be dismounted by removing the mounting screws, then inverted and re-mounted, thus reversing the field. However, Nunan was equivocal about whether or not humbucking circuits were possible with this invention. He made no mention of, or provision for, the fact that if the pickup is in a humbucking circuit and is physically inverted, then the coil connections must be reversed to maintain humbucking.

In US NPPA Ser. No. 15/917,389, Baker disclosed designs for a matched single-coil pickup with a magnet which could be removed by hand and reversed without necessarily removing the pickup from the guitar. In the embodiment with a modified standard vertical-coil pickup, the magnet at the bottom could either be slide sideways out the end of the pickup, or with another embodiment, vertically downwards out of the bottom, then reversed and put back in by hand. That would have required an access panel on the back of the guitar to reach the bottom of the pickup, or removal of the entire pickguard with pickups and controls. The magnet incorporated a shorting contact to signal to a switching controller which magnet pole was toward the strings. But since the coil was not moved, the circuit would remain humbucking.

One embodiment with a horizontal coil required sliding the magnetic core out of the coil horizontally, with a set of shorting contacts to signal to a switching controller the orientation of the magnet. Again, since the coil was not moved, the circuit would have remained humbucking. Another embodiment of the horizontal coil pickup allowed the entire pickup to be dismounted and reversed horizontally, with a shorting contact for the same signaling purpose. But since the coil would have also been reversed in this embodiment, the coil contacts would have to be reversed in the circuit to maintain humbucking. But the horizontal coil pickup turned out to be a much less efficient design, with a string signal tending to be an order of magnitude smaller than the vertical coil pickup.

SUMMARY OF INVENTION

This invention continues in part and discloses more embodiments to fulfill the functions of U.S. Non-Provisional patent application Ser. No. 15/917,389, Baker, 2018, by modifying a common lipstick-style pickup core to have electric contacts on it upper and lower coil form flanges, and a housing with mating electrical contacts, so that it can be manually removed while on the guitar body, inverted and reinserted into the housing. This inverts the magnetic core field and string vibration signal phase, while maintaining the proper phase of external hum signal, to assure that a humbucking circuit including the pickup remains so.

Technical Problems Found and Resolved

Nunan's pickup (U.S. Pat. No. 4,379,421, 1983) has two design flaws: 1) the mounting system is flimsy and cannot be expected to last long; and 2) when the pickup is inverted under the strings, the coil also reversed and a formerly humbucking circuit is no longer. Baker's vertical-coil pickup (US NPPA Ser. No. 15/917,389, 2018) has the magnet below the coil, and it is difficult to reach to invert, requiring the guitar either to have a back panel to remove, which cannot be done with spring-tremolo guitars, or requiring the entire pickguard and electronics to be removed to reach the magnets.

DESCRIPTION OF THE INVENTION AND DETAILED DESCRIPTION OF THE DRAWINGS

Figure 1:
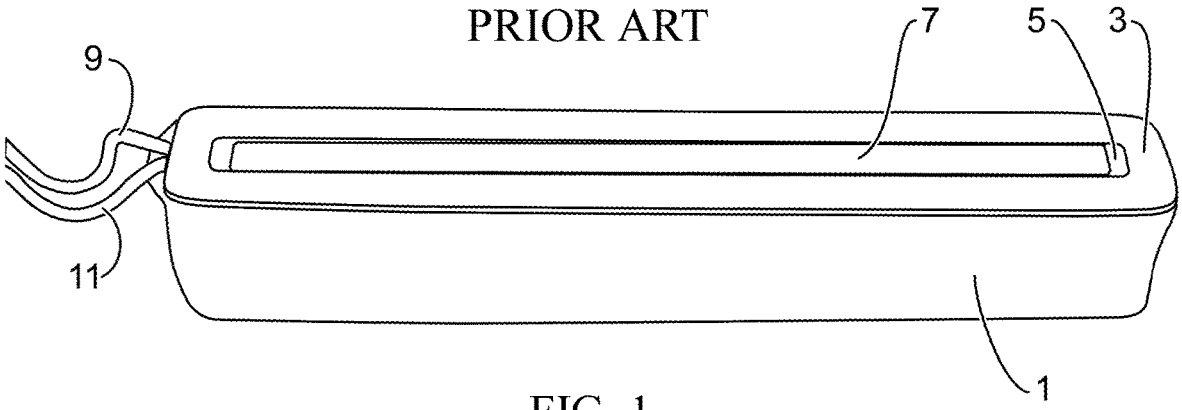
FIG. 1 shows prior art, a drawing of a lipstick guitar pickup core, taken from a photo.

The object of the invention is to provide an electromagnetic musical instrument string vibration pickup with a core, comprised of a magnet, a coil of wire, and a form in which the magnet is placed, and upon or in which the coil is wound, which can be pulled out of a separate pickup housing, reversed so that the other pole faces the strings, and reinserted with mating electrical contacts in or on both the core and the housing, such that the hum-bucking characteristics of the circuit in which it is placed are not affected.

When a coil is reversed or flipped in the direction of an external magnetic field, or hum field, the polarity of the signal at its outputs also reverses. Therefore, the electrical contacts of the invention must be such that flipping the coil also reverses the contacts. In this case, placing the coil contacts on the ends of the flanges of the coil form, which mate with fixed contacts in the pickup housing, serves this purpose. The core must be securely held inside the housing during musical play, so that it does not cause any significant microphonic signal to result. In this invention, the ends and edges of the coil form slide into mating slots and electrical contacts in the coil housing and end cap, serving this purpose.

Humbucking circuits cancel external hum signals that are generated in pickup coils, not upon the directions of the magnetic fields in the pickup magnets. If the magnetic fields have opposite polarity with respect to the strings, then a humbucking pair will have string signals in phase. If the magnetic fields have the same polarity with respect to the strings, then the humbucking pair with have string signals out of phase. That means that for J number of matched, single-coil pickups, there are $2^{J-1}$ number of ways to switch magnetic fields in the pickups to produce string signals of different phases. So a stringed instrument with 3 matched pickups can have 4 sets of tonal characters, in which the tones of the different characters will have some overlap.

It happens that 3 matched pickups can produce 3 distinct humbucking pairs with one set of pole directions, and 4 sets of pole directions sharing 6 distinct humbucking pairs. If the distinct humbucking pairs with reversible magnets can be represented by the numbers 1 to 6, with the odd numbers (1,3,5) being out-of-phase pair signals and the even numbers (2,4,6) being in-phase pair signals, then the 4 tonal characters for 3 matched pickups with reversible magnets can be represented by the groups: (1,3.5), (2,4,5), (2,3,6) and (1,4, 6). Humbucking triples are another matter. It means that a stringed instrument which can maintain a humbucking circuit while using electromagnetic pickups with reversible magnets, either separately or by reversing the entire pickup core, has a wider range of tone and versatility.

FIG. 1 shows prior art, a drawing of a generic lipstick guitar pickup core, traced from a photograph. Most of it is covered around the sides by plastic tape (1), which covers and protects the wire coil (not shown). The top shows the upper flange (3) of the plastic coil form (hidden under the tape), with a hole in the core (5) for the ceramic magnet (7), which is not quite level with the top of the flange. The pickup wires (9 & 11) bring the end connections to the inner and outer turns of the coil out through the tape. In this specimen, the cross-section of the form is about 10.5 mm by 10.5 mm, and the length is about 65 mm. The ceramic magnet is about 3 mm wide by 57 mm long by about 10 mm tall, sitting in a centered slot in coil for about 3 mm by 59 mm. The flange (3) thickness is about 1 mm, leaving the coil of wire sitting in a trough of about 3 mm×8 mm around the outside of the plastic form. There is enough room for about 5000 turns of wire of between 42 and 43 AWG.

Typically, this kind of core slides into a two-part lozenge-shaped housing, divided in the middle and secured by two screws running from inside the housing through a brass base plate, to which the pickup mounting screws and springs are attached. The wires 9 & 11 are soldered to a shielded signal cable, which runs out of a hole in the housing through a mating hole in the base. The pickup can be taken apart, and the core flipped, to create humbucking circuits of matched single-coil pickups, but this flipping does not automatically reverse the contacts.

Figure 2:
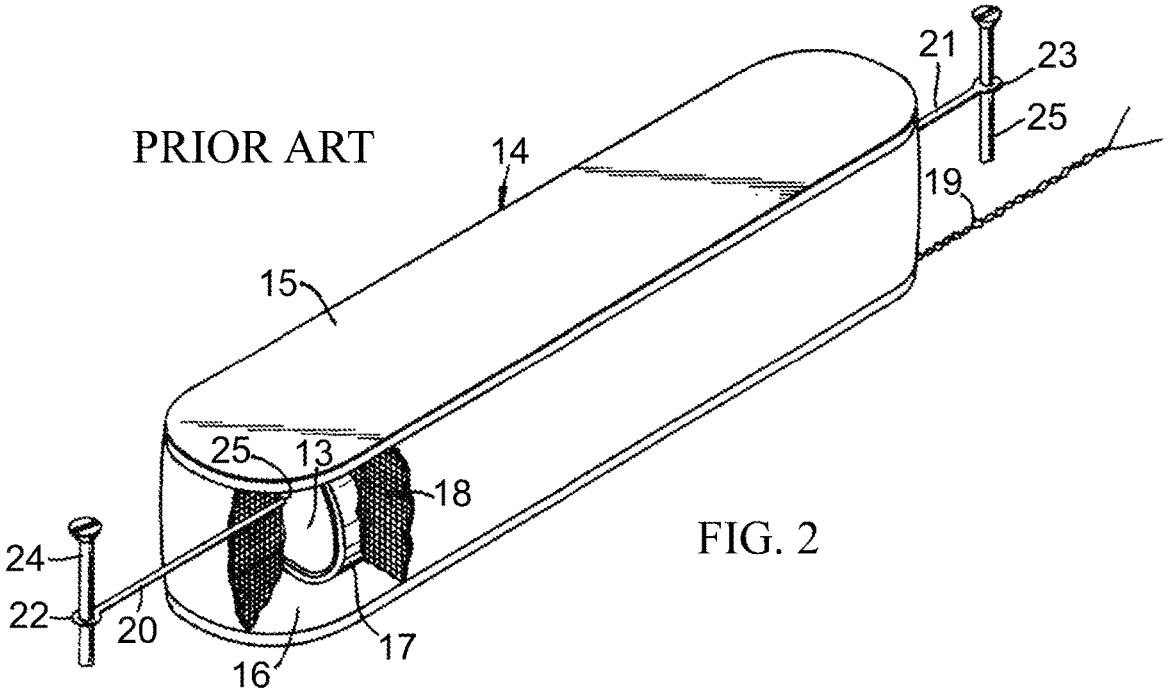
FIG. 2 shows prior art, a drawing from U.S. Pat. No. 4,379,421, Nunan, 1983, the only other inventor found who envisioned an electromagnetic pickup that could be flipped with respect to the strings.

FIG. 2 is prior art, a copy of FIG. 1 from U.S. Pat. No. 4,379,421, Nunan, 1983, with different identifiers, the only other patent drawing by another inventor that Baker could find, showing a pickup that has any capability of flipping pole orientation with any ease. Nunan's identifiers 1 to 13 are shown here as 13 to 25. The full description is in Nunan, just subtract 12 from the identifier here to get Nunan's. Otherwise the pickup wires (19) connect to the coil windings (18), wrapped around the magnet (13) in a coil form (14, 15, 16 & 17). Mounting arms (20, 21, 22 & 23) extend from the magnet to the mounting screws (24 & 25). The direction of the magnetic field goes from one flat to the other (15 & 16), and the pickup and field are reversed by removing the mounting screws, flipping the entire pickup and replacing the screws. This has the same effect as taking a lipstick pickup apart and flipping the core, but still does nothing to automatically reverse the contacts. Note that the wire mounts (21 to 24) are even thinner in the drawing than the mounting screws, and are not only likely to break after some number of reversals, but also allow vibrations that can cause microphonics. Nor does there seem to be any rigid housing protecting the coil (18).

Figure 3:
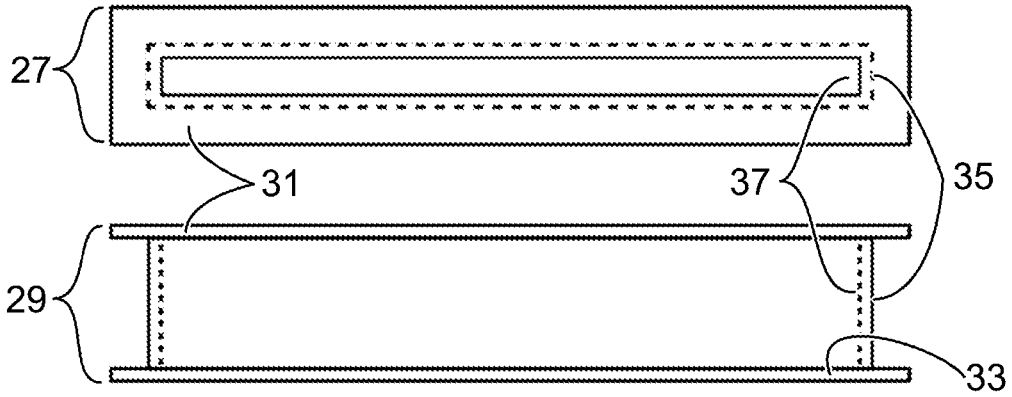
FIG. 3 shows the basic structure of a lipstick coil form, where magnet is held in a central hollow column.

FIG. 3 is one embodiment of the basic pickup coil form, similar to a common lipstick pickup coil form, made of non-magnetic and non-conductive material, with a top view (27) and a side view (29). It has a plate-like top flange (31), a plate-like bottom flange (33), and a central column (35), with hole (37) in which to place the pickup magnet (not shown). The pickup coil (not shown) is wound in the trough formed around the column by the flanges.

Figure 4:
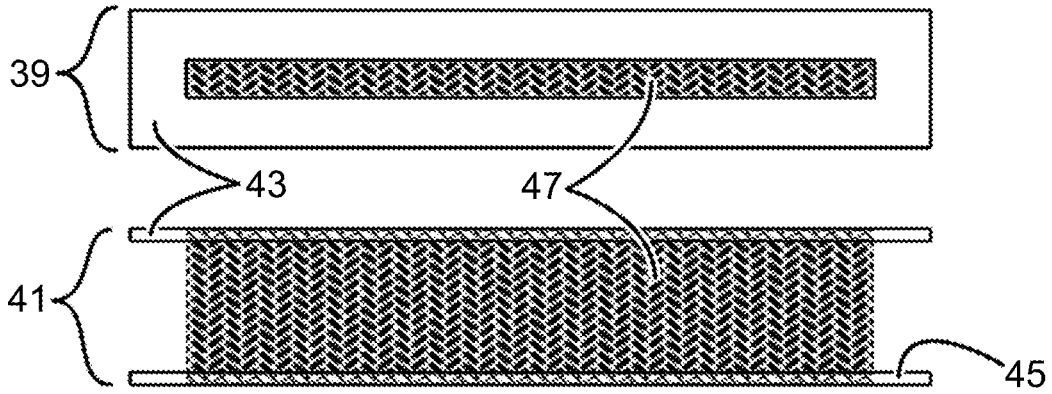
FIG. 4 shows the basic structure of an alternative lipstick coil form, where two flanges are glued to the bare central magnet.

FIG. 4 is another embodiment of the basic coil form, with a top view (39), a side view (41), a top flange (43) and a bottom flange (45). Here, instead of a hollow column connecting the top and bottom flange, the magnet (47) is the column, which is fixed to close-fitting holes (not shown) in the flanges by strong adhesive. The pickup coil (not shown) is wound in the trough formed around the magnet by the flanges. This form allows significantly more turns of wire in the coil than the form in FIG. 3, even if the column (35) is replaced by a thin wrap of soft material around the magnet to protect the coil wire from it.

Figure 5:
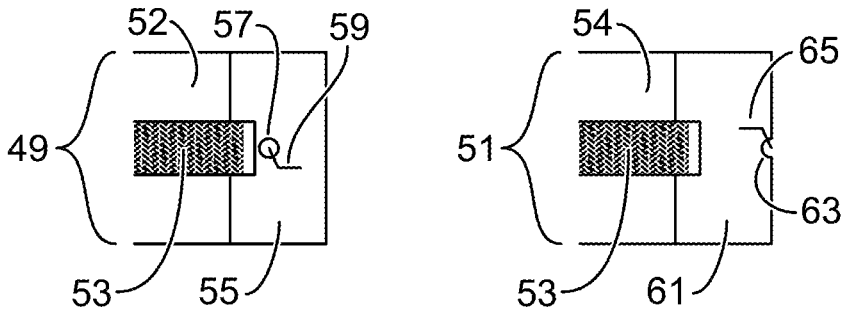
FIG. 5 shows the basic design of coil form flanges with plated ends used for solder point and electrical contacts for the inner and outer windings of a pickup coil.

FIG. 5 shows views opposite flanges (49, 51) of the right ends of either FIG. 3 or FIG. 4, with the magnet (53). For the moment, call (52) the top flange in view (49), the showing the pickup core electrical contact for the inner coil windings, and (54) the bottom flange in view (51), showing the pickup core electrical contact for the outer coil windings, the bottom. The end of the top flange shows a contact area (55) plated on the surface of the flange with some conductive material, preferably metal, with a small hole (57) near the magnet, where the inner turns of the coil (not shown) start. The end of the wire (59) of the inner turns comes through the hole and is electrically attached to the contact area, by either soldering or plating over both. The bottom flange (54) shows a contact area (61) with a notch or hole at the outer edge of the flange (63). The outer turns of the coil finish here, with the end of the wire (65) electrically connected to the contact area.

Figure 6:
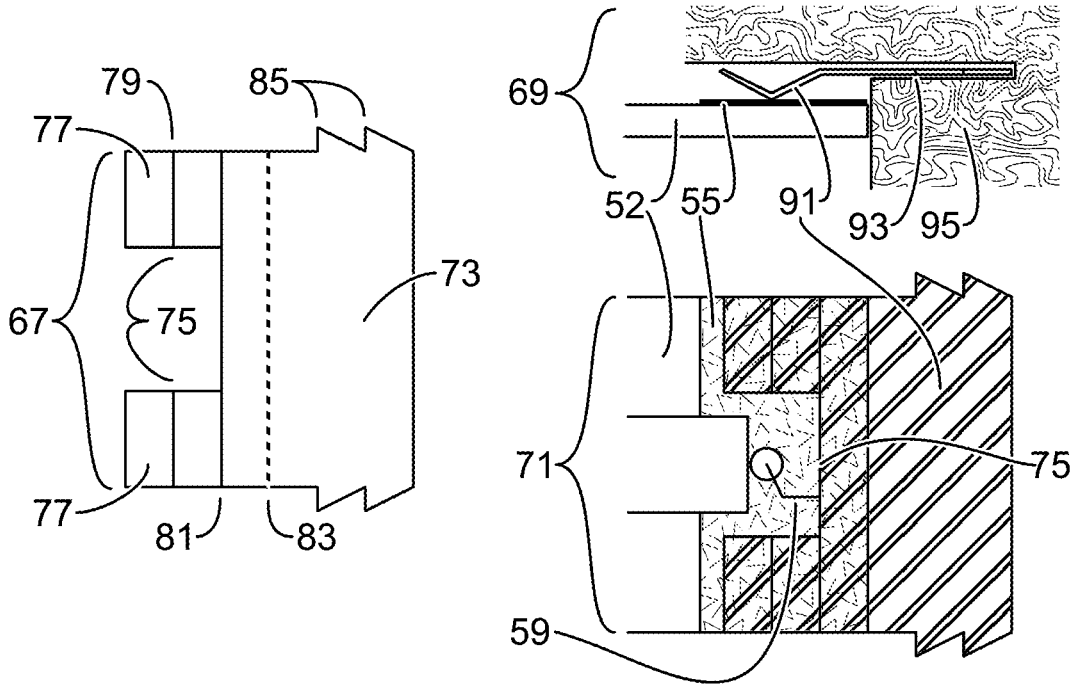
FIG. 6 shows a basic design of an electrical contact in the pickup housing, to mate with the flange contacts shown in FIG. 5.

FIG. 6 shows an embodiment of a mating housing electric contract for (55) in FIG. 5, with view (67) showing a plan view of the mating spring contact (73) with details, view (69) showing the side view of the same spring contact (91), and view (71) showing another plan view of the same spring contact (91) in relation to a flange (52) of the pickup core. In view (67) the spring contact (73) has a notch (75) cut on the left side, leaving two tabs (77). The tabs have bends toward the viewer (79) and away from the viewer (81) to form a line of contact at (79). Another potential bend position (83) can be used to adjust the pressure of the spring contact on the pickup core contact (55 in views (69, 71)). Teeth (85) allow the spring contact to be retained when inserted into a slot in the pickup housing. View (69) show the side view of the spring contact (91) inserted into slot (93) a section of the pickup housing (95). Here the spring contact mates with the plated contact (55) on the end of the coil form flange (52). Other parts of the assembly, such as the electrical paths to the pickup output connections are not shown. View (71) shows the plan view of the mating spring contact (91) over the flange (52) with its plate contact (55), showing how the notch in the spring contact (75) avoids interfering with the connection of the end of the coil wire (59) to the plate contact. Other parts of the assembly are not shown.

Figure 7:
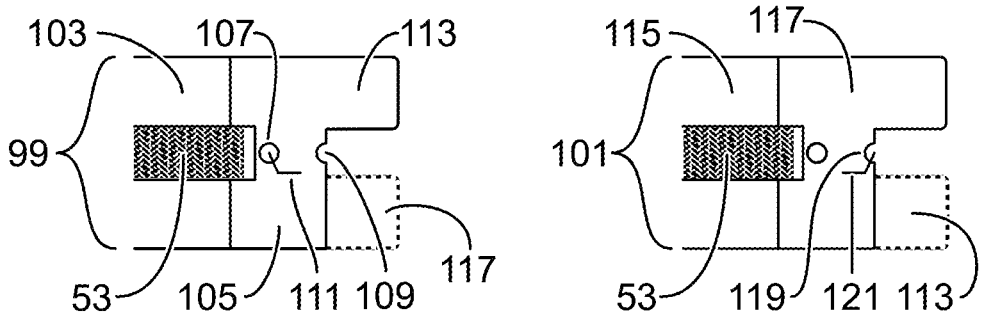
FIG. 7 shows an alternative design/embodiment for pickup coil form flanges which have plated extensions/tabs for mating with pickup housing contacts, which also can be used for either flange, cutting down on the number of different parts.

FIG. 7 shows an alternative embodiment of the electrical contacts on the coil form, with view (99) of the inner coil windings contact (105, 111, 113), and view (101) of the outer coil windings contact (117, 121). View (99) shows the magnet (53) and the end of the coil form flange (103), with the plated contact area (105) having a tab (113) extending out past the area where any coil is wound. View (101) shows the same thing with the other coil form flange (115) and the contact area with an extension (117). In View (99) both the hole (107) to pass the end of the coil (111) for the inner winding, and the notch for the outer windings (109), are present. The same is true in view (101), where the notch (119) passes the end of the coil wire for the outer windings (121) to the electrical contact (117). Thus, if the flanges are attached directly to the magnet (53), with no hollow inner column incorporated into the form, the same part will serve as either flange. Note the dotted lines in each view, (117) in (99) and (113) in (101), showing the positions of the opposite flanges. Using the same flange component, with both the hole and the notch for both flanges, could also have been used in FIG. 5.

Figure 8:
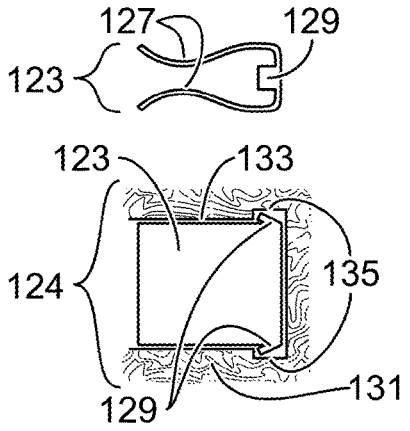
FIG. 8 shows an alternative embodiment of the pickup housing mating contact made to work with the plated flange extensions in FIG. 7.
Figure 8:
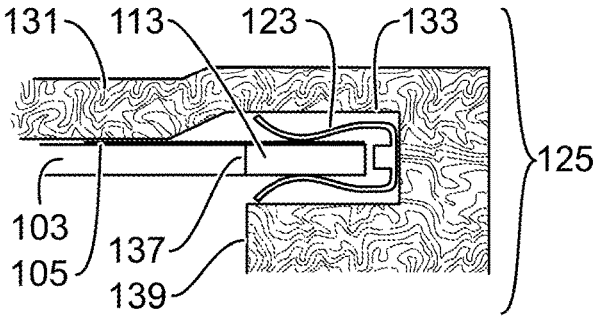

FIG. 8 shows views (123), (124) and (125). View (123) is and shows the side veiw of the mating spring electrical contact for the contact tabs (113 & 117) in FIG. 7, with spring contact points (127) and retention tab(s) (129). View (124) shows the top view of the spring contact (123), as inserted into the socket (133) in a portion of the pickup housing (131), with retention tab pockets (135). View (125) shows the side view of the spring contact (123), inserted into the pocket (133) of a portion of the pickup housing (131), with the electrical contact (105) on the upper flange of the coil form (103) and the tab extension (113) of the flange inserted into the spring contact. The shoulder (137) of the flange, corresponding to the position of the notch (109) in FIG. 7, butts against the vertical wall (139) of this portion of the pickup housing. The electrical connections from the mating spring contact (123) to the pickup output are not shown. For simplicity, the magnet, coil and rest of the coil form are not shown.

Figure 9:
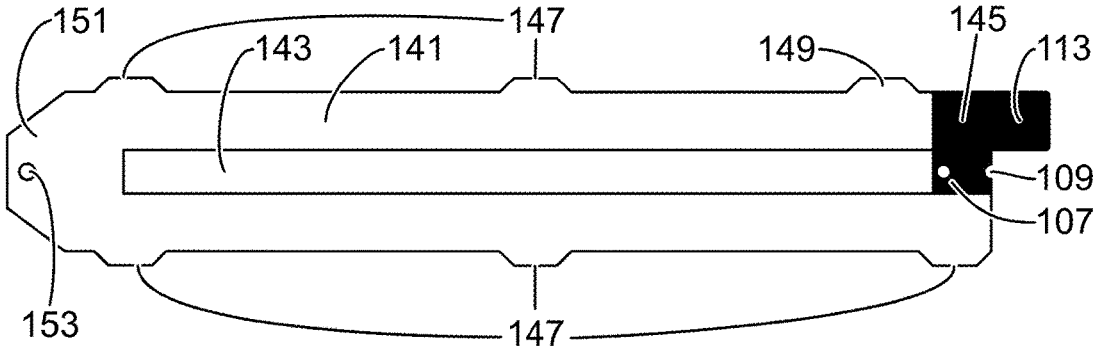
FIG. 9 shows a more complete and detailed design of a coil form flange, with a contact tab as in FIG. 7, with other tabs to engage slots in the pickup housing to guide the coil core contacts into the housing contacts, and to restrict movement, reducing microphonics.

FIG. 9 shows the full length of another embodiment of the flange (141), with a magnet socket hole (143), of the type shown in FIGS. 7 & 8, with additional and alternative details. The plated area (145) attaching the coil wire end holes (107, 109) to the contact tab (113) is alternatively smaller than in FIG. 7. This flange has alignment tabs (147)

to fit into slots in the pickup housing, to hold it steady against shock and vibration, so as to avoid microphonics. One tab (149) is offset, away from the contact plating (145), so that the plating will not bind in the slot. However, an alternative embodiment (not shown) would have the rest of the flange surface plated as in (145), but grounded and not connected to (145), for shielding. The other end of the flange has another alignment tab (151), with a pull-hole (153) which fits into a mating slot in the pickup housing closure door (not shown here). The pickup housing and closure door, or end cap, are made and sized so that the mating trapezoidal slot in the closure door pushes the pickup core flanges into firm contact with the interior housing end wall (139 in FIG. 8). This further reduces microphonics.

Figure 10:
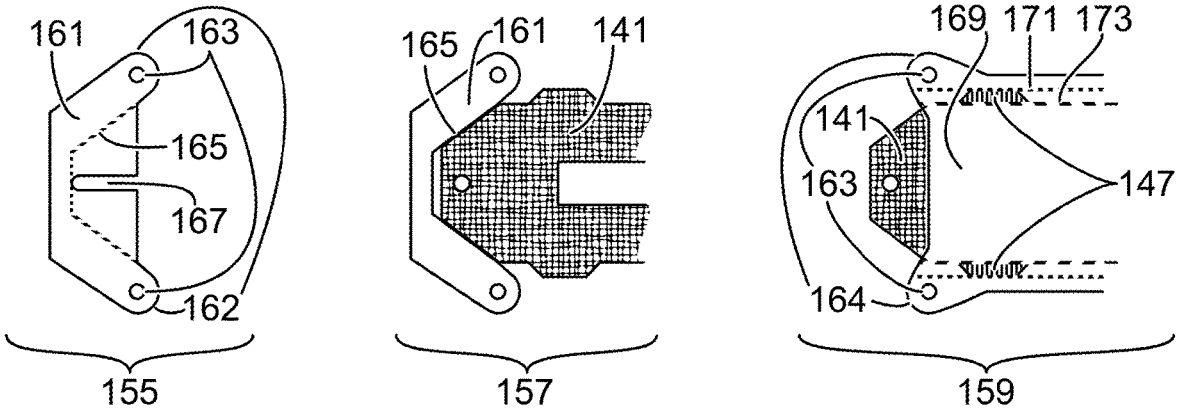
FIG. 10 shows of a pivoting end cap, attached to the main pickup housing by pins and ears, to allow the pickup core to be removed, then replaced and held firmly in place inside the main housing.

FIG. 10 shows views (155), (157) and (159). View (155) shows the top view of the end cap of the pickup housing (161) with hinge pins (163) in hinge ears (162), interior slots (165) to accept the left end of the coil form flanges (151, FIG. 9), and a strain relief slot (167) to allow the end cap to flex slightly at its middle. View (157) shows a cross section of the end cap (161) at the flange slot (165), with the flange (141) positioned within it. View (159) shows that end of the pickup housing (169) with hinge pins (163) in hinge ears (164), and the flange (141) protruding from it when the pickup core is fully inserted into the housing. Flange tabs (147) slide into slots (171) in the inner wall (173) of the housing (169).

The flange pull-holes (FIG. 9, 153) in the indexing tabs (151) can also serve another purpose. A solid pin can be fixed in the holes from flange to flange, and the slot (167) in FIG. 10 can be reshaped so that when the end cap is opened and rotated on the hinge pin, it pulls on the pin in the flange holes to help pull the core out of the housing and away from the electrical contacts in the housing. Then, when the end cap is fully opened, about 180 degrees of rotation on the hinge pin, a simple hook can grab the pin between the flanges and pull the core all the way out. Part of the bottom of the end cap flexure slot (167) can be set closer to the pin, so that it will help force the core into the housing electrical contacts on closing the end cap.

Note also that the pickup core obviously can and should be marked as to which pole of the magnet, North or South, is pointing towards the strings. Two colors of paint would be simplest, such as blue for North and red for South.

Figure 11:
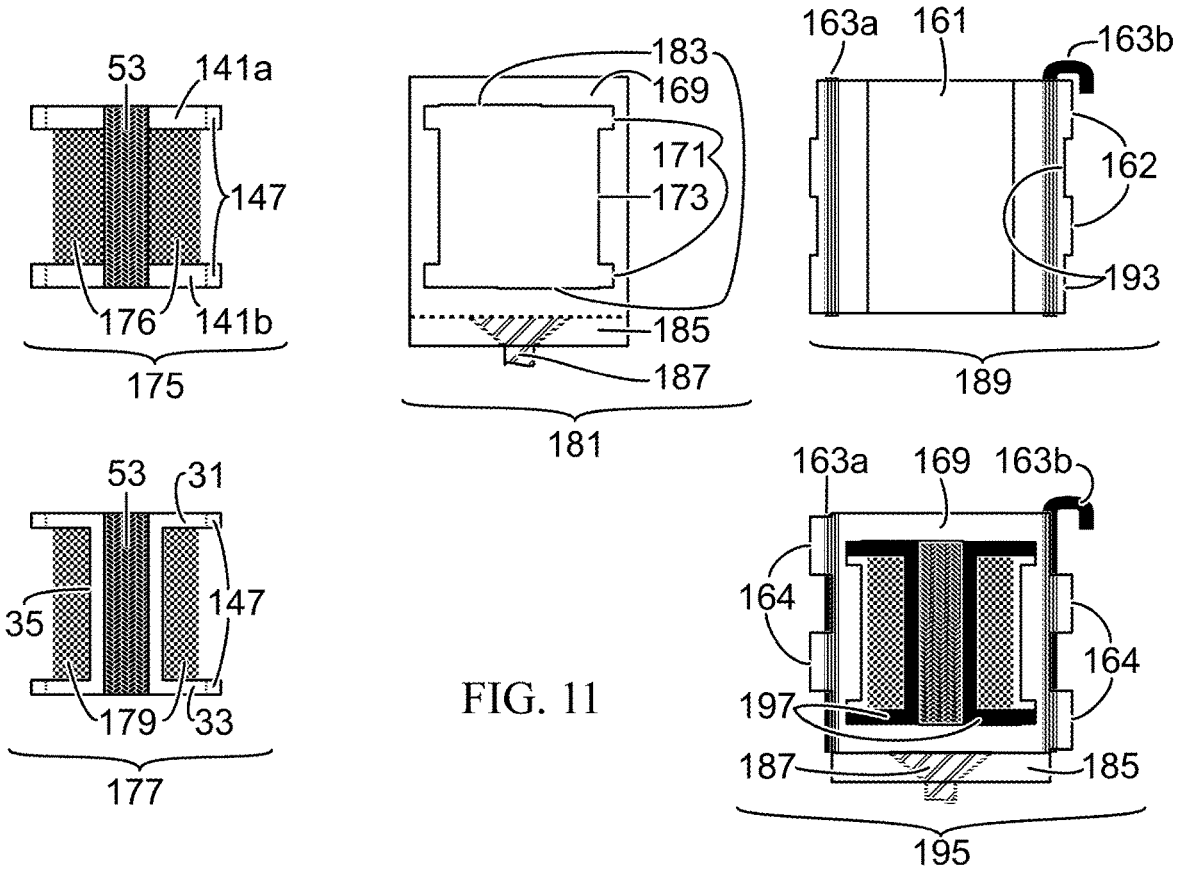
FIG. 11 shows details of two different pickup core embodiments from the end where the core can be pulled out, shows how they fit into the main housing center and slots, shows the end cap and the hinge and latch pins, and shows the mounting tab and screw at that end.

FIG. 11 shows views (175), (177), (181), (189) and (195), from the end of the pickup opposite the contacts. View (175) shows a cross-section of the pickup core of the embodiment type in FIG. 4, with coil for flanges (141*a*, 141*b*) fixed to the magnet (53), around which the coil turns (176) are wound, including the indexing tabs (147, labeled only on the right side) of the flange type shown in FIG. 9. View (177) shows the other embodiment type from FIG. 3, where the coil form is a single piece, with flanges (31) and (33) connected by a central hollow column (35) in which the magnet (53) resides. The coil turns (179) are wound around the central column. This cross section also goes through indexing tabs (147, labeled only on the right side). Note that the coil form in View (175) has more room for coil turns than the form in View (177) and has more sturdy flanges, and thus is the preferred embodiment.

View (181) shows a cross-section of the pickup housing (169), with indexing tab slots (171) cut or molded into the inner wall (173), relief cuts (183) at the top and bottom to pass the contact plating (145 in FIG. 9), the position of the pickup mounting tab (185) at that end, and the position of the flathead pickup mounting screw (187). View (189) shows the end cap (161) with the hinge pin (163*a*) and the latch pin (163*b*) in hinge ears (162, labeled only on the right side). The indented parts (193) cover the housing hinge ears (164, not shown). Note that this arrangement is 180-degree symmetrical and reversed on the other side (not numbered), allowing the end cap to be rotated 180 degrees about the center of the pickup core without affecting its function. The latch pin (163*b*) is shaped to be removable, with a cane-like handle. Any other kind of graspable protuberance which does not interfere with function could also be used, but is not shown here. The hinge and latch pins are sized to be replaced/repaired with either standard paper clip wire or guitar string. View (195) shows the non-contact end of the pickup housing (169), with the hinge ears (164) holding the hinge pin (163*a*) and the latch pin (163*b*). The housing contains the embodiment of the pickup core in (177), with the coil form (197) in black, and the magnet and coil shown but not numbered. The pickup mounting tab (185) at that end, with the pickup mounting screw (187), are shown in position as they extend out of the drawing.

Figure 12:
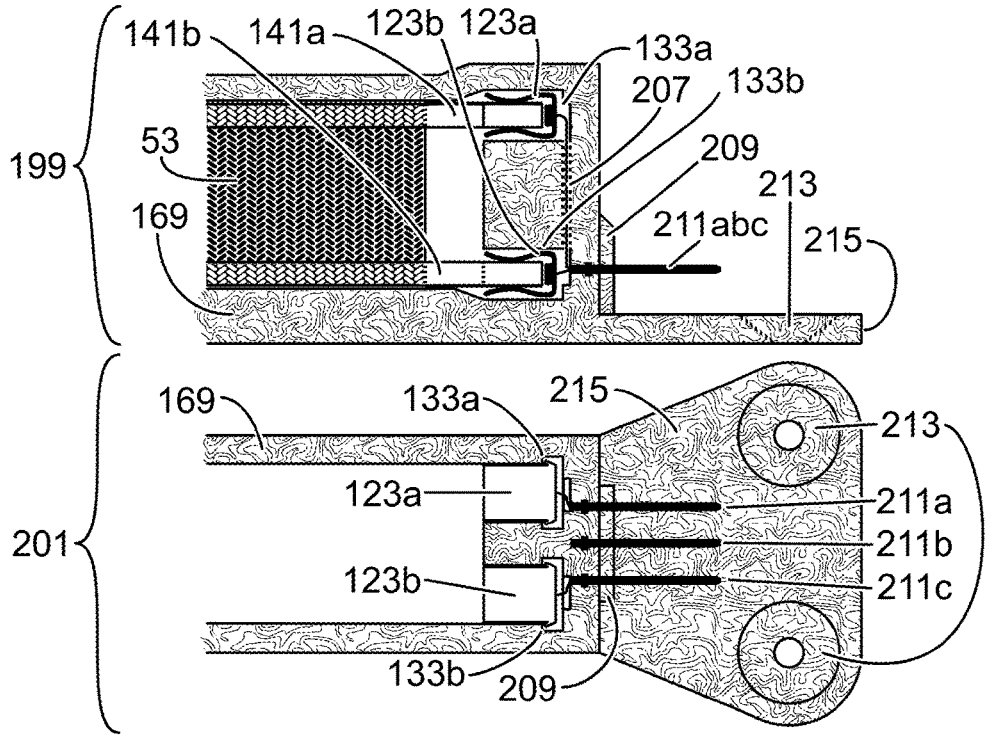
FIG. 12 shows the other end of the pickup housing, where the electrical contacts of the coil form tabs in FIGS. 7, 8 & 9 mate with the housing contacts, which are connected to output pins between two mounting screws at that end of the pickup housing.

FIG. 12 shows side view (199) and top view (201) of the end of the pickup housing opposite the end cap, with electrical contacts. Both are pseudo-cutaway views, cut not on one plane, but to show parts, particularly the contacts, in their relative positions. View (199) shows the cutaway side view of the pickup housing (169), with parts of the pickup core, the upper (141*a*) and lower (141*b*) coil form flanges from the embodiments in FIGS. 7, 8 & 9, and the magnet (53) with the coil not shown. The flange electrical contact tabs (not numbered) fit into the upper (123*a*) and lower (123*b*) housing spring contacts, in the upper (133*a*) and lower (133*b*) contact pockets. The spring contacts connect by electrical pathways (207) in the housing to outside contact pins (211*abc*) as also shown in view (201). The pins (211*abc*) are embedded in the housing with a reinforcing block (209), extending out over the contact end mounting tab (215) with flathead screw holes (213).

View (201) shows a top view of the same end of the housing (169), without the pickup core inserted, with a pseudo-cutaway view of the upper (123*a*) and lower (123*b*) spring contacts shown in their relative positions, sitting in the upper (133*a*) and lower (133*b*) contact sockets. The upper contact (123*a*) connects via an electrical pathway (not numbered) to exterior pin (211*a*). The lower contact (123*b*) connects to the exterior pin (211*c*). The center pin (211*b*) is reserved for a grounded electrostatic pickup shield (not shown). Here, the mounting tab (215) has two screw holes (213), spaced to avoid interference with the wire electrical connector (not shown) that mates with pins (211*a, b* & *c*). The horizontal extent of the reinforcing block (209) is shown. The dimensions of the reinforcement block (209) and pins (211) are taken from a common type of square-pin header connector, but could be of any type, including a female socket, or male or female micro-connector, or even a micro-USB connector. They could also be replaced by lead wires with strain relief at the housing. The preferred embodiment is whatever standard connector can be integrated into the housing with the most reliable service and least cost. Using two screws at one end of the pickup housing adds both stability and adjustment, allowing the pickup to be leveled both along its length and width with respect to the plane of the instrument body, if mounted on springs or foam. Similar detailed Figures are not shown for the other spring contact embodiment from FIG. 8

Normally, pickup coils are shielded either by grounded copper tape wrapped on top of the coil, but insulated from it, or the pickup housing is metallic and grounded. Copper tape wrapped directly on top of the coil tends to increase the internal capacitance of the coil and to shunt a small portion of the higher frequencies to ground. A metal pickup housing tends to allow eddy currents to form in the housing as a direct result of currents in the pickup coil, and also tends to depress some of the higher frequencies. Anecdotally, at least, signals from pickups with metal covers are said to be less bright.

Figure 13:
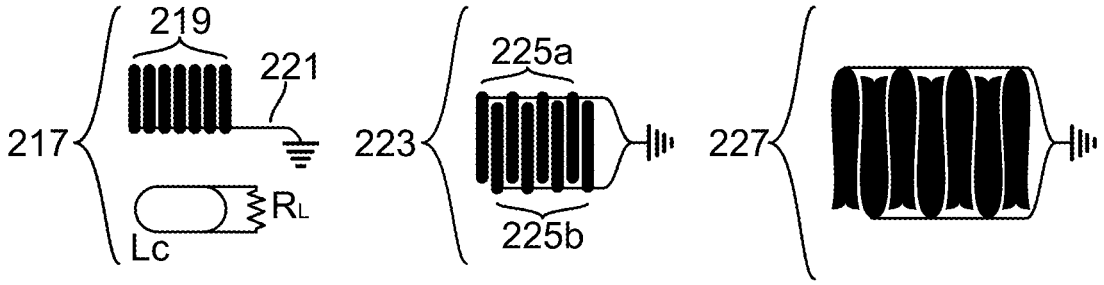
FIG. 13 shows the basic design of comb shields, used to shield the pickup coil and break up eddy currents.

FIG. 13 shows views (217), (223) and (227) of a simplified electrostatic shielding system, meant to be attached or plated to the outside of the pickup housing, and attached to pin 211*b* in FIG. 12. View (217) shows a set of parallel conductors (219), closely spaced but not touching, grounded at one and only one end (221), and perpendicular to the long axis of the pickup coil, Lc. String vibrations create voltage fluctuations in Lc, which drive a small AC current across the load resistor, $R_L$. Thus, when one or more of such shields are placed about the pickup coil, the eddy currents are broken up into much smaller physical loops, tending to reduce the depression of higher frequencies, while maintaining a large degree of the shielding. View (223) shows a double-comb interleaved shield, with interleaved fingers (225*a*, 225*b*). View (227) shows a slightly more decorative interleaved comb shield, looking like fish in a can. So long as the rules are maintained, much more decorative and artistic shields are possible, from tiger stripes to floral to steam punk to Escher-like effects. Placed on the outside of the housing, this shielding system will have less effect of internal coil capacitance.

Figure 14:
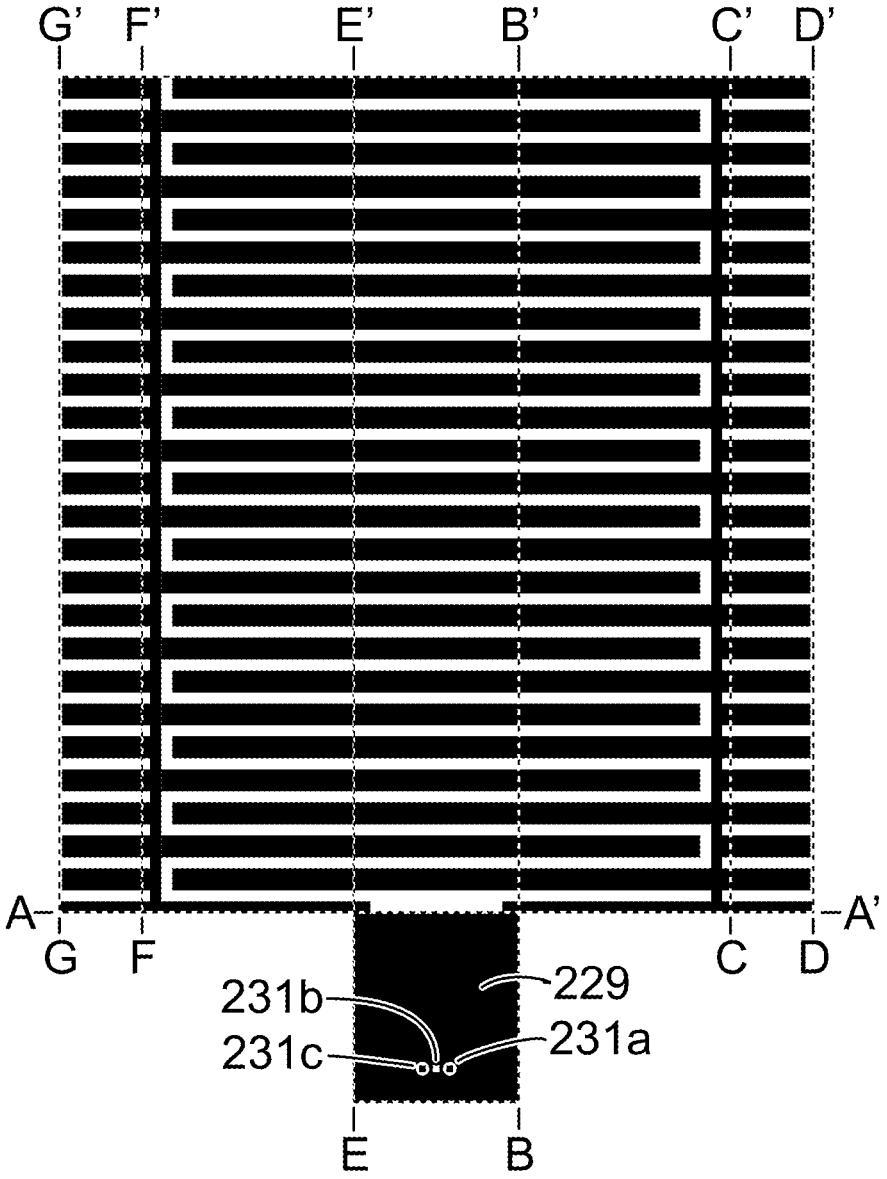
FIG. 14 shows the more detailed design of a possible comb shield to be either plated or adhered to the outside of the pickup housing, and electrically connected to one of the output pins.

FIG. 14 shows a possible pattern of comb shields like those in FIG. 13, unwrapped from around the pickup housing from FIGS. 11 & 12, ignoring any bumps in the faces of the housing. The black areas are conductor, with non-conductive white gaps in between. The shield is either plated on the housing or attached to it with adhesive as a flexible printed circuit. Line A-A' shows the "fold" at the top of the contact end of the housing, as viewed from that end. Most of the contact end of the housing can be shield (229) without creating significant eddy currents. Open areas (231*a*, 231*c*) in the shield pattern around the pins (211*a*, 211*c*, in FIG. 12, not numbered here) leave them ungrounded, while the shield is connected to pin 211*b* (not shown) at 23 lb. Fold lines B-B' and E-E' correspond to the right and left top of the pickup housing. Fold lines C-C' and F-F' correspond to the bottom right and bottom left of the housing. Lines D-D' and G-G' almost meet in the middle of the bottom of the housing, with a small gap between them. If the pickup is mounted directly to the guitar body, and the guitar body itself has a conductive shield layer, then the pickup shield should be insulated from it to avoid ground loops. A single-point ground system in guitar electronic circuits is always preferred.

Note that the bottom parts C to D and F to G are single-comb patterns, and the sides and top from C to F are interleaved double-comb patterns. The gaps between the comb teeth conductors are exaggerated to make them easier to see. This is just one possible embodiment, easy to design, but not necessarily preferred. While not shown, the end cap (161, not shown) from FIGS. 10 & 11 can be either plated non-conductor or metal and entirely conductive, connected electrically to the pickup housing shield pattern through the metal hinge pin (163*a*, FIG. 11, not shown), if the shield pattern is plated directly on the housing. Plating the shield pattern on the housing is likely more difficult than using flexible printed circuit glued to the housing, but preferred where possible. A shield pattern can be cut from a solid plated conductive layer on the housing by either mask and acid or laser methods. For decorative shields, it is possible to color the pattern selectively, by plating, painting or other methods, with other colors of material.

In another embodiment, not shown in the Figures, the shield can be double-sided and flexible printed circuit material, glued to the pickup housing, where the gaps in the comb shield on one side of the flexible circuit material are completely covered by offset conductive comb teeth in the shield on the other side. This is a natural extension of the invention, and may be advisible for higher-frequency electrical interference from appliances like fluorescent lights and SCR-controlled variable lighting.

Figure 15:
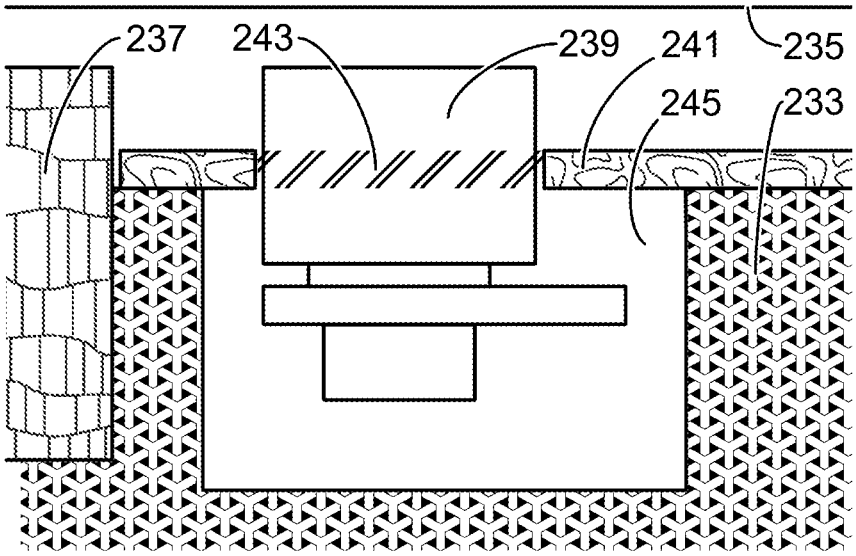
FIG. 15 PRIOR ART
FIG. 15 shows from prior art how a pickup with a reversible core intended to be removed from one end cannot be mounted in a standard pickguard on a guitar body or in a pickup cavity in the body.

FIG. 15 shows prior art, a cross-section of a guitar body (233) and neck (237) under the 3 or 4 string (235), with a standard ceramic magnet single-coil neck pickup (239) in relation to the pickguard (241, 243) and the pickup cavity (245) in the body. The pickup mounting to the pickguard is not shown. Obviously, even if the pick core could be brought out of the end of the pickup, the pickguard would be in the way, unless sections of pickguard are removable, with corresponding cavities in the body. Therefore, to use the invention disclosed here most effectively, the body should be made differently.

Figure 16:
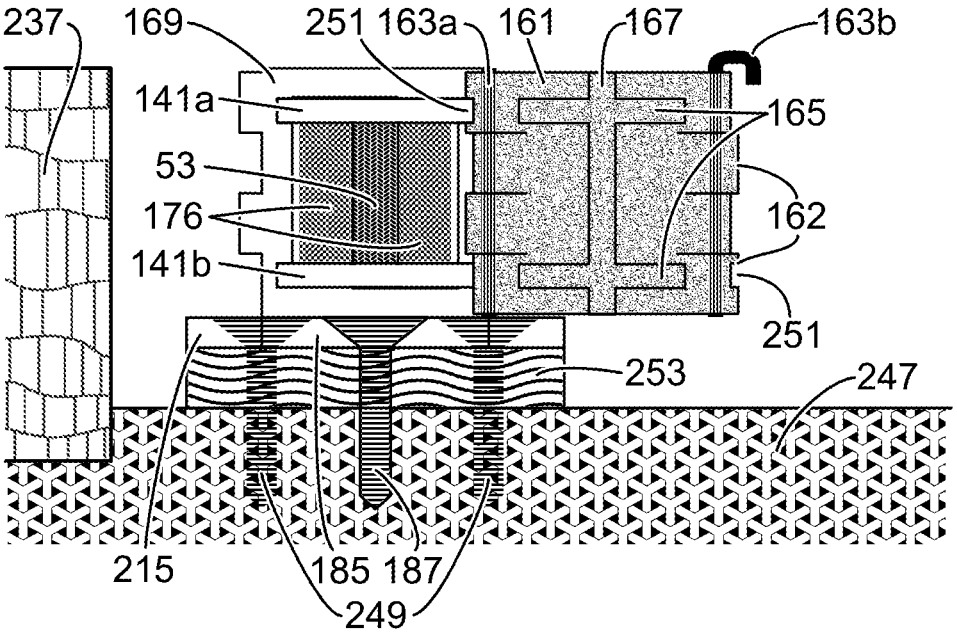
FIG. 16 shows how the guitar body must be lowered to both mount the invention, and have access to it.

FIG. 16 shows the body (247) cut much lower in the region of the pickup, almost down to the bottom of the neck (237) so that the pickup housing (169) can be mounted to it with screws (187, 249) on a compressible pad (253). This is the view of a right-handed guitarist looking down on the belly side of the instrument. The other features of the invention are numbered as before, with the exception of grooves (251, not shown in FIG. 11, View 195) cut into two of the end cap (161) hinge ears (162), so as to allow the removal of the pickup core (53, 141*a*, 141*b*, 176). The need for them had not been seen until this drawing was made. In this view, the previously unseen inside of the end cap is shown, with the positions of slots 165 & 167 apparent. In this case, because of the proximity of the pickup to the neck, the hinge pin (163*a*) and latch pin (163*b*) are reversed in position, so that the end cap can be opened without hitting the neck. The mounting tab (185) at the end cap end of the housing is shown with the mounting screw (187). The mounting tab (215) at the contact end of the housing peaks out around the sides, with the positions of its mounting screws (249) shown for reference. The pickguard (not shown) may be present behind the pickups, mounted of a raise portion of the body (not shown) to house the electrical circuits and components, but is not necessary to illustrate these points.

I claim:

1. A pickup device for generating an electrical vibration signal from moving ferro-magnetic parts of a musical instrument, comprising of two main electro-mechanical parts, a fixed pickup housing, generally attached to said musical instrument and providing electrical connections to other electrical circuits on said instrument, and a pickup core which is removable from said housing, which contains electromechanical parts for deriving said vibration signal, and which is physically invertible so as to reverse the phase of said vibrational signal upon re-insertion into said pickup housing, further comprising of:

a. said pickup core, comprising of a magnet, a coil form and a wire coil of many turns, including inner turns and outer turns, of a single magnet wire about said magnet within said coil form, further comprising of:

i. wherein said magnet is a bipolar magnet with its field oriented parallel to the axis of said wire coil, preferably singular and generally a rectangular bar shape; and ii. said coil form comprising of two identical plate-like flanges, called upper and lower to distinguish the one toward and away from said vibrating parts, respectively, each flange mounted on said magnet at the pole faces of said magnet, with a slot-like hole near the center of each said flange, sized and shaped to allow said magnet to pass at least partially through said hole, said flanges affixed to said magnet by ordinary means, such as pressure fit and/or adhesive, so that said magnet and flanges form a U-shaped trough, or coil form, into which said wire coil can be wound around said magnet; said coil form further comprising of:

1. an electrical contact on each said flange, at one end of the long axis of said pickup core, such that said contacts have 180-degree radial symmetry about said long axis of said pickup core volume; and
2. holes in said upper and lower flanges of said coil form, in or near said electrical contacts, through which wire ends of said wire coil pass so that they are secured or soldered to said electrical contacts, such that said wire ends will not be dislodged upon removal or insertion of said pickup core from or into said fixed housing; and
3. small side tabs extending out from long edges of said flanges in the plane of said flanges, configured to engage said pickup housing to aid in orienting and holding secure said pickup core, so as to avoid undesirable microphonics; and
4. an end tab on each said flange, on an end of the pickup core opposite of the end with said electrical contacts, extending across the width of said flange with a small hole in said end tab, such that wire or pick-like tools can be inserted into said holes on one or both flanges and used to pull said pickup core from said pickup housing; and iii. said coil of magnet wire, which is wound and connected consistently the same on all said pickup cores of all such claimed devices, wherein:

1. a first wire end from the inner turns of said wire coil is always consistently attached to a first contact, of said electrical contacts on said flanges, adjacent to a first pole of the two poles of said central flat rectangular magnet, and
2. a second wire end from the outer turns of said coil is attached to a second contact, of the electrical contacts, adjacent to the second of the two poles of said central bar-like magnet; and b. said pickup housing, having a long, hollow rectangular box form with an end cap or lid, mounting feet or flanges, and electrical circuits and connections, providing for said pickup core a means of holding said pickup core in place on said musical instrument, allowing said pickup core to be removed from and replaced in said pickup housing, shielding said pickup core from outside electrical interference, and connecting said wire coil of said pickup core to other electrical circuits in said musical instrument, said pickup housing further comprising of:

i. electrical mating spring contacts mounted internally in a first end of said pickup housing, preferably away from a player of said instrument, facing into said hollow inside of said pickup housing and facing toward and mating with said electrical contacts on said core flanges, wherein said internal mating electrical contacts are placed within pockets or slots in said pickup housing, said pockets or slots extending from the interior of said pickup housing towards but not reaching the exterior of said pickup housing; and ii. electrical contacts mounted externally on said first end of said pickup housing, connected by electrical circuits through said pickup housing to said internal mating spring contacts with said pickup core, allowing said wire coil in said pickup core to be connected to other circuits in or on said musical instrument; and iii. an electrical shield for said pickup housing, being plated, adhered or otherwise affixed to said housing, said electrical shield further comprising of:

1. a single ground contact, connected, either to a shield ground of external electrical wires or to a shield pin or socket of one of said external electrical connector on said pickup housing, and
2. one or more ground conductors in said electrical shield running laterally from a grounding connection of said pickup housing to a farther end of said pickup housing, without producing any current loops; and
3. separate fingers of conductors, much longer than wide, and much wider than a separation between said fingers of conductors, connected at one end and one end only to said ground conductor or conductors, each of said fingers of conductors which do not touch any other finger, said fingers of conductors running across said housing, perpendicular to the direction of current in said wire coil; and iv. internal slots (171) in said pickup housing, in the long sides of said pickup housing not facing either said musical instrument or said moving ferro-magnetic parts, engaging said side tabs in said pickup core flanges, for holding said pickup core in place, so that said pickup core will not move relative to said pickup housing and said musical instrument, thus avoiding undesirable microphonics; and v. shallow grooves (183) on the interior of said pickup housing, said shallow grooves located in walls of said pickup housing that are parallel to said musical instrument, said shallow grooves constructed to pass, without impedance or friction, the parts of said electrical contacts and said wire connections to said contacts as may be raised beyond surfaces of said flanges adjacent to the insides of said housing; and vi. said end cap at said end of said pickup core housing, opposite the end of said electrical contacts, tending to a flattened rectangular shape with a short dimension along the long axis of said pickup housing, constructed with 180-degree radial symmetry about said long axis, so that it can be rotated 180 degrees in a plane of the end of said pickup housing and still function as intended, oriented preferably on the end of said pickup housing towards the instrument player, said end cap configured to be opened and closed, allowing said pickup core to be removed, inverted with respect to said moving parts and a body of said musical instrument, and reinserted, after which said end cap is closed to hold said pickup core in position, said end cap being affixed to said pickup housing by hinge ears on said end cap pinned to mating hinge ears on said pickup housing with a hinge pin on a first side of said end cap, and a latch pin on the opposite side of said end cap, said hinge ears offset from an internal volume of said pickup housing so as not to impede the passage of said pickup core out of or in to said pickup housing, further comprising of, 1. slots in said mating hinge ears as necessary, allowing said side tabs of said pickup core to pass out of the end of the pickup housing when said end cap is open; and
2. mating slots in said end cap to accept said end tabs of said pickup core flanges, so as both to hold said flanges in position and to tend to push said core into said pickup housing and said pickup housing electrical contacts when said end cap is closed on said core; and
3. said hinge and latch pins and the corresponding holes in said hinge ears sized so as to be replaceable and repairable with a standard paperclip wire or guitar string; and
4. said latch pin having a U-bend or other graspable protuberance at the end nearest said moving parts of said instrument to allow it to be seized, lifted and removed from said hinge ears so that said end cap can be opened and swung upon said hinge pin; and vii. ordinary means, such as mounting tabs, springs, foam, screws, and/or adhesive, of mounting said pickup housing securely to the musical instrument, without interfering either with the opening of said end cap at one end of said pickup housing or the mating of said external electrical connectors or wire at the other end of said housing.

2. The pickup device for a musical instrument as recited in claim 1, wherein said flange with said electrical contact connected to said inner turns, referred to here as said inner winding flange, has a hole near said bar magnet to pass the wire end from said inner turns of said wire coil to said electrical contact on that said inner winding flange, and said flange connected to said outer turns, referred to here as said outer winging flange, has a notch or hole on or near an outer edge of said outer winding flange to pass the wire end from said outer turns to said electrical contact on said outer winding flange.

3. The pickup device for a musical instrument as recited in claim 1, wherein both said flanges are of identical structure and have both a hole near said magnet and a hole or notch near the outer edge of said flange, for passing the wire ends from said inner and outer turns of said wire coil to said electrical contacts on said flanges, so that said flanges have identical structure, this arrangement being preferred.

4. The pickup device for a musical instrument as recited in claim 1, wherein said flanges are of identical structure, and said electrical contacts on said flanges are placed or plated on said flanges at said contact ends of said flanges, and extend across the width of said flanges, with said wire pass-through holes in middles of said contacts, said holes tending to be in a line of a long axis of said pickup core.

5. The pickup device for a musical instrument as recited in claim 1, in which each of said flanges is constructed the same and has a tab-like extension at said end with said electrical contact, incorporating said contact, to one side of the long axis of said flange, extending past a volume of said wire coil, forming an electrical finger or pin contact, with conductive plating on at least one side, to mate with matching female electrical spring mating contacts in said pickup housing, each of said flanges affixed to said magnet so that said finger contacts have 180-degree radial symmetry about the long axis of said pickup core.

6. The pickup device for a musical instrument as recited in claim 1, wherein a central non-magnetic column connects said flanges, with a tubular hollow for holding said magnet.

7. The pickup device for a musical instrument as recited in claim 1, wherein the internal mating spring contacts housed in the contact end of said housing have teeth formed thereon and are placed to oppose removal of each of said internal mating spring contacts from the respective said pocket or slot in said pickup housing in which said internal mating spring contact is placed, without interfering with the spring contact action of said internal mating contact.

8. The pickup device for a musical instrument as recited in claim 1, wherein said pickup housing internal mating spring contacts have semi-flexible tabs which engage in deeper portions of said slots or pockets in said pickup housing, so that when said housing internal contacts are inserted into said slots or pockets in said pickup housing for holding said mating spring contacts, said contacts cannot be pulled back out of said slots or pockets, but said semi-flexible tabs do not interfere with the spring or contact action of said internal mating spring contacts.

9. The pickup device for a musical instrument as recited in claim 1, wherein said housing internal mating spring contacts are conductive electrical spring leaf contacts, comprising of:

a. a first relatively planar and flat end, inserted into a slot or pocket in said housing, including either teeth or semi-flexible tabs for retention in said slot or pocket; and
b. at a second end of said mating spring contacts, opposite the first end, each of said mating spring contacts contacting one of said flange electrical contacts on a respective one of said coil form flanges, each said spring contact having at least two bends (79, 81), said bends being parallel to said opposite end of a respective mating spring contact, one or more of said bends configured to bring said second end of a respective mating spring contact down into contact (79, 127) with a respective one of said flange contacts, and one or more bends configured to bend said end of said respective mating spring contact away from said respective flange contact, forming a V-shaped or U-shaped contact, so as to present a sloping surface to said flange end to meet and push up, so that the bottom curve of the V or U sits below the level of said respective flange contact and is forced by spring-action normal to hold said V or U shape to said respective flange contact after said flange contact forces it up and slides under it; and
c. a notch (75) in said V-shaped or U-shaped contact area of said housing internal mating contact, as necessary, to avoid impinging on any of said coil wire end connections.

10. The pickup device for a musical instrument as recited in claim 1, wherein said housing internal mating spring contacts are each a conductive electrical spring clamp contact of a C-shape, each comprising of:

a. an originally flat conductive piece, bent into a C-shape, the bend of the C-shape inserted into a retention pocket in said pickup housing, using either teeth or semi-flexible tabs for retention in said pocket, and
b. wherein the ends of said C-shape are recurved into lips that provide two lines of contact (127) with each said flange electrical contact and bevels configured to meet the said contact end of said respective flange to force said lips apart wherein said lips provide a spring clamping action.

11. The pickup device for a musical instrument as recited in claim 1, wherein said holes in said end tabs of said flanges, used to pull said pickup core from said pickup housing, are transfixed by a solid pin or wire, preferably non-magnetic, after said wire coil is wound and otherwise constructed, so as to facilitate ease of removal of said core, by grasping or hooking said solid pin or wire instead of said holes.

12. The pickup device for a musical instrument as recited in claim 1, wherein said electric shield is located on or in said pickup housing and conducts through said hinge ears, or conductive plating on said hinge ears, to a continuation of said electric shield either on said end cap if said end cap is made of non-conductive material, or in said end cap if said end cap is made of conductive material.

13. The pickup device for a musical instrument as recited in claim 1, wherein said end cap hinge ears pinned to said mating hinge ears form hinges and wherein said end cap has a slot, cut parallel to said hinges and midway between said hinges, so as to allow said end cap to flex slightly as needed to allow said latch pin to more easily engage said hinge ears on its side of said housing.

14. The pickup device for a musical instrument as recited in claim 1, wherein:

a. said holes in said end tabs of said flanges, used to pull said pickup core from said pickup housing, are transfixed by a solid pin or wire, preferably non-magnetic, after said wire coil is wound and otherwise constructed, so as to facilitate ease of removal of said core, by grasping or hooking said solid pin or wire instead of said holes; and b. wherein said end cap hinge ears pinned to said mating hinge ears form hinges and said end cap has a slot, cut parallel to said hinges and midway between said hinges, so as to allow said end cap to flex slightly as needed to allow said latch pin to more easily engage said hinge ears on its side of said housing; and c. said slot in said end cap is shaped to allow said pin not to interfere with the opening of said end cap, preferably providing some impetus by cam action to help automatically pull said core from said housing as said end cap is opened, and to help push said core into said housing as said end cap is closed.

15. The pickup device for a musical instrument as recited in claim 1, wherein said mounting tabs are situated at each end of the long dimension of said pickup housing, on the side adjacent to said instrument body, also known as the bottom, comprising of:

a. a first mounting tab at one end of said pickup housing, preferably nearest the player of said instrument, drilled and countersunk for a flathead mounting screw, such that opening said end cap will not encounter said screw or said mounting tab; and b. a second mounting tab at the other end of said pickup housing, preferably away from the player, wider than said first mounting tab, drilled and countersunk for two flathead screws, said screws situated to either side of said external pickup wires or connector, so as not to interfere with the position or orientation of said wires or connector.

* * * * *